US005704467A

United States Patent [19]

Jarvis

[11] Patent Number: 5,704,467

[45] Date of Patent: Jan. 6, 1998

[54] KEYPADS

[75] Inventor: Peter Willis Jarvis, Berkhamstead, United Kingdom

[73] Assignee: Keymat Technology Limited, United Kingdom

[21] Appl. No.: 535,195

[22] PCT Filed: Apr. 20, 1993

[86] PCT No.: PCT/GB94/00834

§ 371 Date: Oct. 19, 1995

§ 102(e) Date: Oct. 19, 1995

[87] PCT Pub. No.: WO94/24684

PCT Pub. Date: Oct. 27, 1994

[30] Foreign Application Priority Data

Apr. 20, 1993 [GB] United Kingdom ..... 9308118

[51] Int. Cl.[6] ..... H01H 13/06

[52] U.S. Cl. ..... 200/302.2; 200/512; 200/513

[58] Field of Search ..... 200/302.2, 341, 200/345, 512, 513, 302.1, 520

[56] References Cited

U.S. PATENT DOCUMENTS

| | | | |
|---|---|---|---|
| 5,144,103 | 9/1992 | Suwa | 200/512 |
| 5,172,805 | 12/1992 | Gumb | 200/302.2 |
| 5,203,448 | 4/1993 | Osada et al. | 200/345 |
| 5,442,152 | 8/1995 | Huang | 200/345 |
| 5,516,996 | 5/1996 | Shin | 200/512 |

FOREIGN PATENT DOCUMENTS

| | | | |
|---|---|---|---|
| 1207469 | 12/1969 | Germany . | |
| 3149222 | 6/1983 | Germany . | |
| 387732 | 3/1965 | Switzerland . | |
| 2219691 | 12/1989 | United Kingdom | 200/512 |
| 2260443 | 4/1993 | United Kingdom . | |

*Primary Examiner*—David J. Walczak
*Attorney, Agent, or Firm*—Fields & Johnson, P.C.

[57] ABSTRACT

A keypad is provided wherein the keys are sealingly mounted in keyholes provided in a housing by means of a key mount which centers each key and seals the space between each key and the edge of its keyhole. The key mount also provides an electrical contact which is brought into engagement with underlying circuitry in response to depression of a key. The key mount also resiliently mounts the key within the keyhole so after depression of the key the key mount returns the key to its initial position in which the contact is spaced from the circuitry.

16 Claims, 5 Drawing Sheets

KEYPADS

The invention relates to keypads and particularly, but not exclusively to keypads for use in hostile environments or keypads likely to be subject to vandalism.

There are two main types of keypad currently in use. In one type, the keys are protected by an overlay of a waterproof flexible elastomeric material which has marked zones identifying the location of the keys beneath the layer. Such keypads can be subject to wear and ripping and thus require frequent replacement.

In a second form of keypad, a key-plate is provided with keyholes through which project individual keys. These keys can be depressed in order to operate circuitry beneath the associated key.

Such keys suffer from the disadvantage that they are generally mounted in such a way that they can move laterally relative to the associated keyhole and engage the associated keyhole. This can cause wear and eventually may prevent the key functioning at all. In addition, such lateral movement can allow a knife or other object to be inserted between the key and the keyhole and the circuitry beneath to be attacked. Further, such an arrangement can often allow the ingress of water, dust or other damaging matter between the key and the keyhole and into the interior of the keypad where damage to the circuit can be caused.

According to the invention there is provided a keypad comprising a housing including at least one key hole and a key located in said hole, there being provided a key mount sealingly engaged with the key hole to prevent the passage between the mount and the key hole of damaging matter, the key mount locating said push-button relative to said key hole.

By providing a key mount which engages the key and the internal surface, ingress of contaminants into the housing through the gap between the key and the housing is prevented and the key is accurately positioned relative to the housing.

Preferably, the key mount includes a peripheral rib sealingly engaging a locating member provided on the housing and extending around the associated key hole. The rib may be provided with a channel sealingly receiving a locating flange provided on the housing. The rib and the flange are preferably rectangular.

The key mount may carry a separately formed key for manual operation. The key is preferably connected to the key mount by an interference fit between a part of the key and a part of the key mount. The key part may be a recess and the key mount part a projection.

The recess and the projection may be of circular cross-section. In this case the recess and the projection may include co-operating formations to prevent rotation of the key relative to the key mount. The formations may comprise a projection in the recess and a depression in the projection. The projection and the depression may be cruciform in shape with the limb of each such shape leading from an edge of the associated part.

The key and the key hole are preferably rectangular in cross-section. The key may be provided with means which, on depression of the key, create a flow of air tending to expel liquid held between the associated key mount and the housing.

The key mount is preferably formed from an elastomeric material with the peripheral rib being connected to a central core forming said key by a flexible web which holds the core normally in an inoperative position, the core being movable to an operative position against the force applied by the web to operate the associated switch.

The core may carry a contact, with the housing including a circuit board having a switch operated by said contact when the core moves to said operative position. Preferably, the switch is operated when the key is below the level of an adjacent surface of the housing.

There are preferably a plurality of keys and key mounts. The key mounts may in this case be formed separately. Alternatively, they may be formed as a single member.

A specific embodiment of the invention will now be described, by way of example only, with reference to and as illustrated by, the accompanying drawings, in which.

Figure 1:
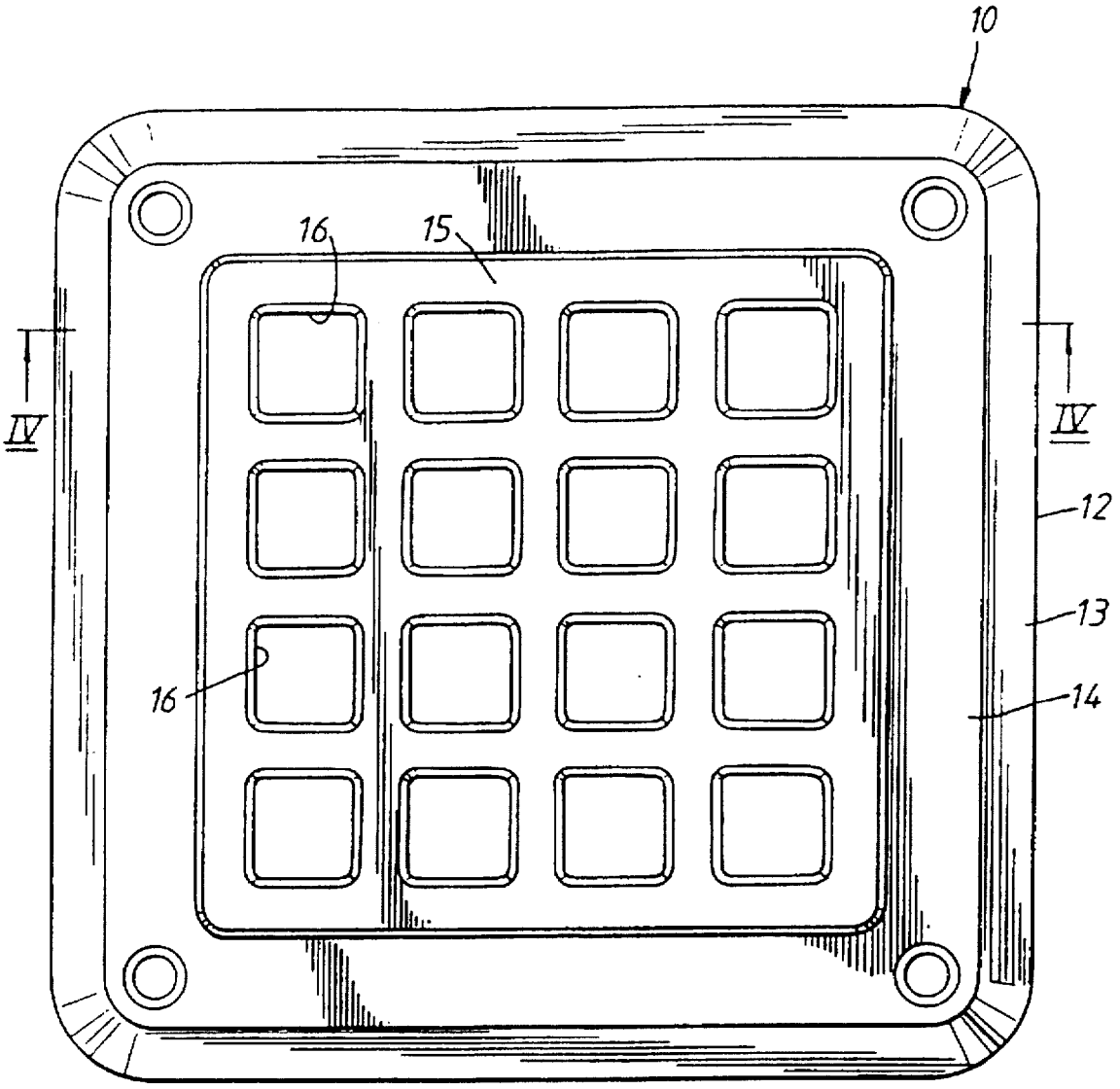
FIG. 1 is a plan view from above of a housing of a key pad.
Figure 2:
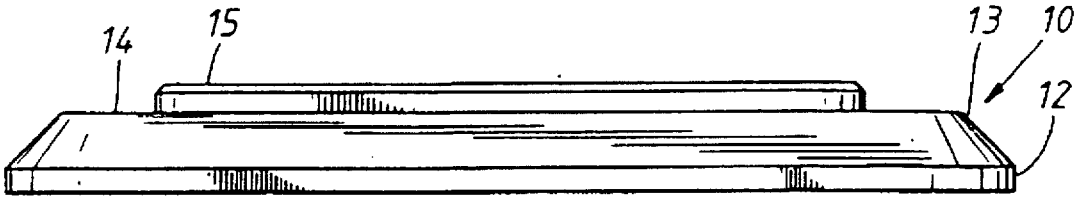
FIG. 2 is a side elevation of the housing of FIG. 1.

With reference to FIGS. 1 to 4, the keypad comprises a generally square flat aluminium alloy housing 10. The housing 10 may, of course, be made of any other suitable material. The housing has an outer peripheral wall 12 extending upwardly (as viewed in FIG. 2) and leading to an inwardly bevelled wall 13 which in turn leads to a horizontally extending plate 14 (as viewed in FIG. 2).

The plate 14 surrounds a generally square key-plate 15 provided with sixteen regularly arranged keyholes 16. The key-plate 15 stands slightly proud of the plate 14, as seen in FIG. 4.

Figure 4:
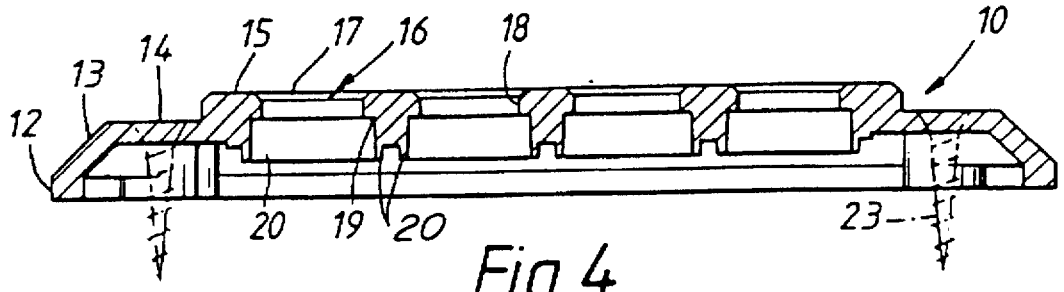
FIG. 4 is a section along the line IV—IV of FIG. 1.

The cross-section of each keyhole 16 in the key-plate 15 is best seen in FIG. 4. In section, each hole has, on the outer surface of the key-plate 15, a bevelled surface 17 leading to an axially extending surface 18. There is then an outwardly directed rebate 19 which terminates in a locating flange 20, whose function will be described below.

Figure 3:
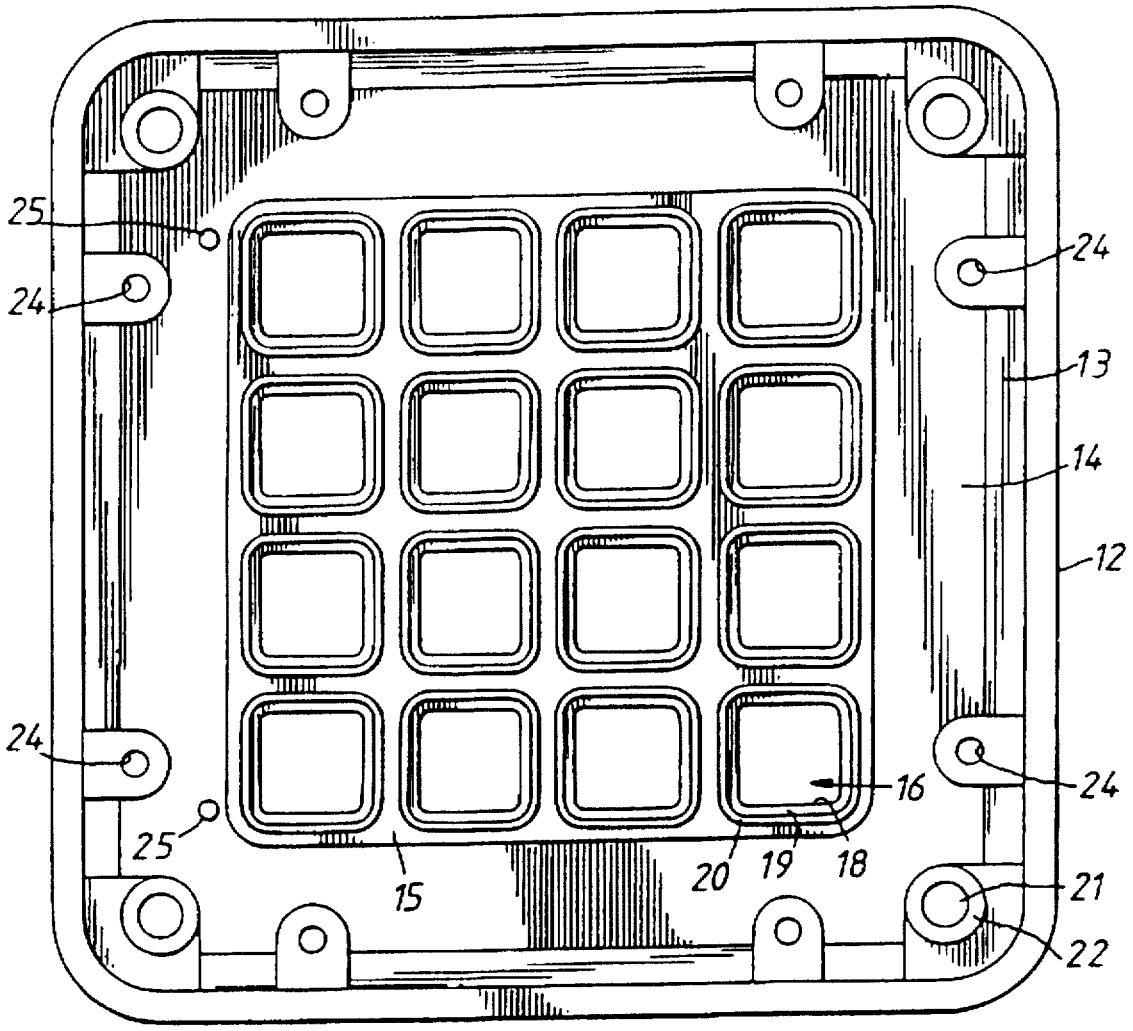
FIG. 3 is an underneath plan view of the housing of FIGS. 1 and 2.

The housing 10 is provided with various mounting points which are best seen in FIGS. 1 and 3. In each corner of the housing 10 on the plate 14 there is provided an aperture 21 which leads to a tube 22 which terminates at a point level with the lower edge of the wall 12. This allows the housing 10 to be fixed to a surface by screws 23 (FIG. 4) which extend through the apertures 21 and the tubes 22 into a mounting surface. The tubes 22 ensure that any water or other fluid leaking past the screws 23 is discharged to the rear of the housing 10.

The housing 10 also has four threaded holes 24 which allow a back plate (not shown) to be fixed to the housing 10.

In addition, two parallel locating pins 25 (see FIG. 3) project into the housing from the rear of the plate 14. These allow circuit board 47 to be located in the housing.

Figure 5:
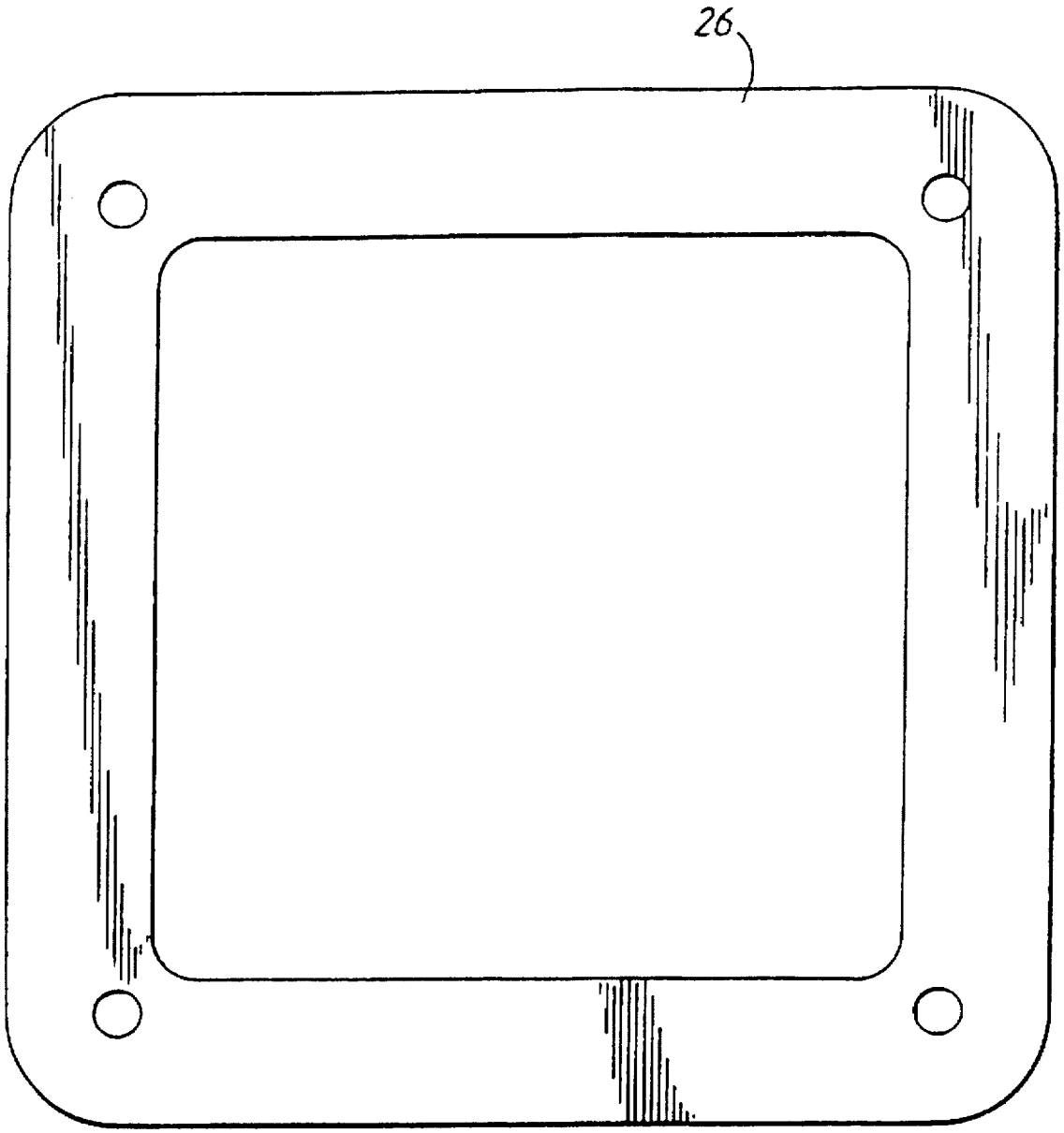
FIG. 5 is a plan view of a gasket used in mounting the housing to a surface.

When the housing 10 is mounted on a surface, a gasket 26 shown in FIG. 5 is placed between the housing 10 and the surface. This gasket 26 is engaged by the edge of the wall 12 which is pressed against the gasket 26 by the screws 23 to form a water-tight seal.

Figure 8:
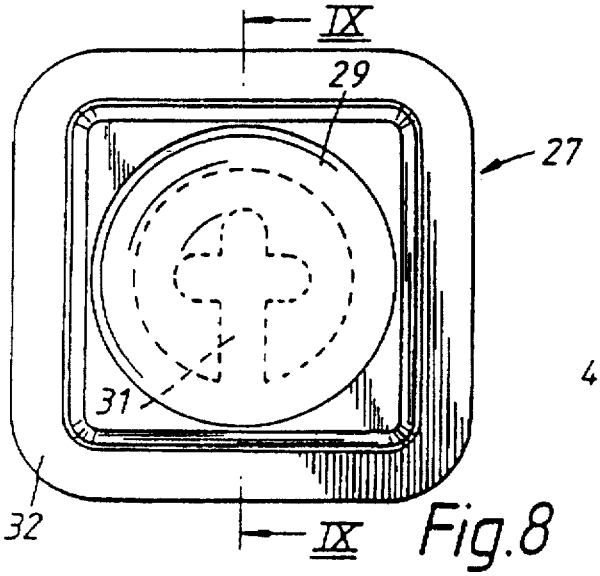
FIG. 8 is a plan view of one of the keys for mounting on the housing by the key mount of FIGS. 6 and 7.
Figure 9:
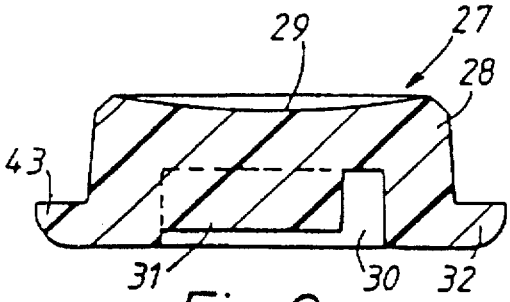
FIG. 9 is a section through the key shown in FIG. 8 along the line IX—IX of FIG. 8.

The key-plate 15 carries sixteen keys, one of which is shown at 27 in FIGS. 8 and 9. Each key 27 projects through one of the keyholes 16 and is mounted on the key-plate 15 in a manner to be described below.

Each key 27 has, as best seen in FIG. 8, a rectangular body 28 whose upper surface is provided with a concave depression 29 to allow a finger to locate on the key. The depression 29 may be provided with a distinguishing character, such as a letter or number.

The interior of the body 28 is formed with a circular aperture 30 that is provided with a cruciform projection 31 extending from one edge of the aperture, as seen in FIG. 8.

A flat edge strip 32 extends around, and projects from, the lower edge of the body 28.

Figure 6:
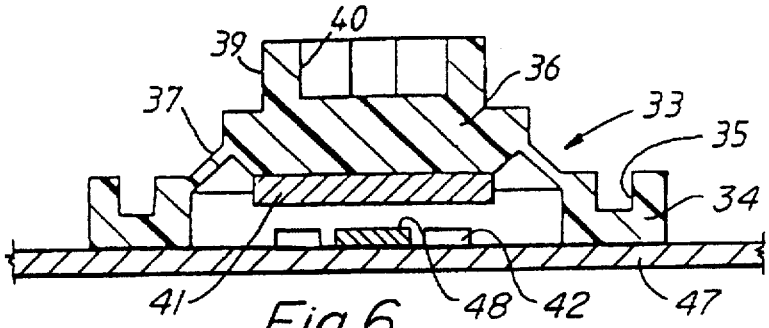
FIG. 6 is a section through a key mount for mounting a key on the housing of FIGS. 1 to 4.
Figure 7:
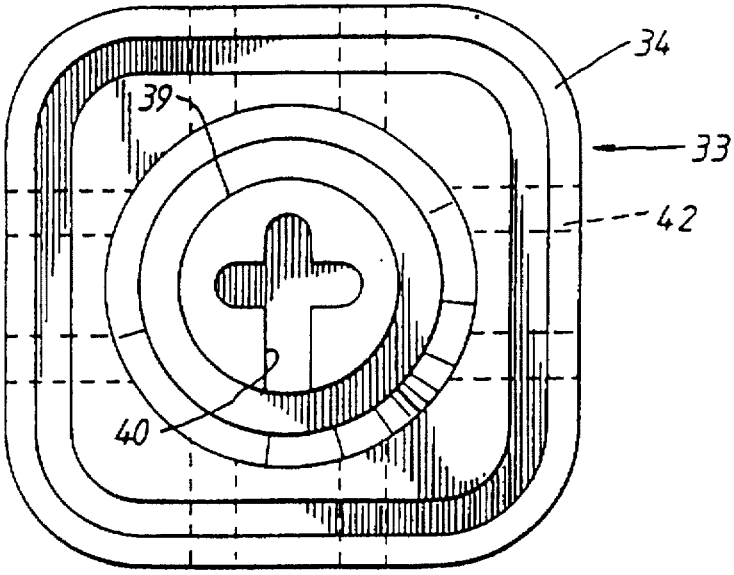
FIG. 7 is a plan view of the key mount shown in FIG. 6.

Each key 27 is mounted on the key-plate 15 by a key mount 33 shown in FIGS. 6 and 7. Each key-mount 33 is formed from an elastomeric material and, as seen in FIG. 7, is generally rectangular in plan view with a circular central projection. The key mount 33 is formed with a rectangular outer rib 34 of generally rectangular cross-section and provided on its upper surface with a square section channel 35. A lower surface of the rib 34 is provided, along each side, with two grooves 42 connecting inner and outer walls of the rib 34. The rib 34 is connected to a generally circular core 36 by an angled flexible web 37, best seen in FIG. 6. The web 37 holds the core 36 in the position shown in the drawings but allows the core 36 to be moved axially; providing a restoring force returning the core 36 to the position shown in the drawings.

The core 36 has at its upper end an axially extending annular outer wall 39 and a cruciform depression 40 that is complementary to the cruciform projection 31 on each push-button 27. The lower end of the core 36 carries a conductive contact 41. As shown in FIG. 6, circuit board 47 includes a complementary contact 48 which engages contact 41 when the key 27 is depressed.

The keypad is assembled as follows.

First, each key 27 is connected to a key mount 33 by pushing the aperture 30 of the key 27 over the outer wall 39 of the core 36 of a key mount 33. The outer wall 39 of the core 36 is designed to be a tight fit within the aperture 30 of the associated key 27 and the key 27 is orientated such that the cruciform projection 31 locates in the cruciform depression 40 in the core 36. This acts to prevent rotation of the push-button 27 relative to the key mount 33. The fact that the depression 40 opens on to the outer wall 39 of the core 36 allows air to escape as the key 27 is placed on the key-mount 33.

The key mount 33 is then mounted on the key-plate 15 by inserting a locating flange 20 in the channel 35 in the rib 34 of the key mount 33.

This process is repeated for all sixteen keys 27. A suitable circuit board 47 of known type is then located on the pins 25 and presses against the surfaces of the ribs 34 of the key mounts 32. This urges the ribs 34 against the locating flanges 20 to ensure a seal between the parts.

The backing plate, referred to above but not shown, is then fixed to the housing 10 using the screw-holes 24 and the whole keypad assembly can then be mounted on a surface, again as described above. Suitable connectors will be provided between the circuit board 47 and associated electrical equipment.

The keys 27 are sized so that they are smaller than the keyholes 16, and thus there is a spacing between the body 28 of each key 27 and the axially extending portion 18 of each keyhole 16. The key mount 33 serves to locate the associated key 27 in this position so avoiding any possibility of contact between the key 27 and the associated keyhole 16.

The arrangement of the keyholes 16 and the locating flanges 20 is such that when the key mounts 33 engage the locating flanges 20, there is a small space between the ribs 34 of adjacent key mounts 33. This is to allow the rib to flex and spread as the associated push-button 27 is depressed.

Further, the seal formed between the rib 34 of each key mount 33 and the locating flange 20 of the associated keyhole 16 prevents the ingress into the interior of the housing 10 of any dust, water or other harmful fluid or matter. The curved portions 43 of the edge strip 32 of each key 27 act to provide an air flow that expels dust, water and other fluids from the cavity formed between each keyhole and the associated key 27 and key mount 33, as the key 27 is depressed.

The travel of the core 36 between the undepressed and depressed positions of the key 27 is designed so that the web 37 is never in tension. This increases significantly the life of the web 37.

The grooves 42 in the ribs 34 of the key mounts 33 allow the escape of air from beneath the key mounts as the associated key 27 is depressed.

The travel of each key 27 is also designed so that the contact 41 does not engage the contact 48 of the circuit board 49 until the associated key 27 is below the level of the outer surface of the associated keyhole 16. This means that if a key 27 is hit, it will not operate the switch.

It has been found that the arrangement described above with reference to the drawings provides a high level of screening against electromagnetic radiation both inwardly and outwardly.

Figure 10:
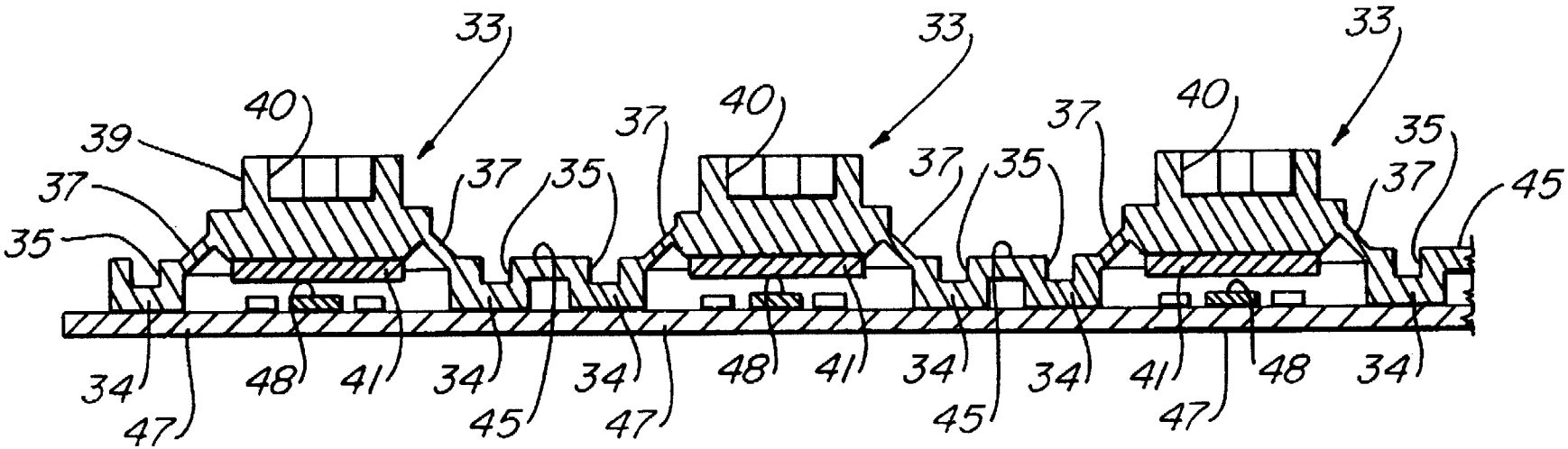
FIG. 10 is a section through a plurality of key mounts interconnected as by corresponding web portions.

It will be appreciated that there are a very large number of alternatives. The key mounts 33 need not be made separately. They could be made in one piece with a thin web between them. For example, FIG. 10 illustrates a plurality of key mounts 33 interconnected by web portions 45. Engagement between each key 27 and the associated key mount 33 need not be by the cruciform projection/depression, any other suitable shape may be used. The keyhole 16 need not be square, it could be any other suitable shape with the shape of the associates parts being altered accordingly. The key mounts 33 may be provided with a rib or other form of connection that sealingly engages the housing 10.

There need not be sixteen keyholes 16 and keys 27; there could be any suitable number.

The keys 27 could be omitted with the core 36 forming the key.

Preferably, the gap between each key 27 and the associated keyhole 16 is such that it is not possible to insert a knife through the gap to damage the key mount 33. This is aided by the fact that the flat edge strip 32 of each key 27 overlaps the outwardly directed rebate 19 of the associated keyhole 16.

I claim:

1. A keypad comprising a housing including a key plate having a plurality of keyholes, at least two of said plurality of keyholes each being surrounded by a respective locating flange extending away from the key plate, said keypad further comprising a plurality of key mounts and a plurality of associated keys wherein each key mount locates a respective associated key relative to a respective key hole so that the associated key projects through the respective key hole, at least two key mounts of said plurality of key mounts each including an endless peripheral rib having an endless channel for sealing engagement with a said respective locating flange, surrounding one of said at least two keyholes to prevent the passage of damaging matter into an interior portion of said at least two key mounts, each key-mount further comprising a first contact attached thereto.

2. A keypad according to claim 1 wherein each associated key is formed separately from the corresponding key mount and is carried by the corresponding key mount for manual operation.

3. A keypad according to claim 1 wherein a respective locating flange is spaced from an edge of said housing, each associated key having a flat edge strip which overlaps a portion of the housing between said edge and said respective locating flange.

4. A keypad according to claim 1 wherein each associated key is connected to the corresponding key mount by an interference fit between a part of the associated key and a part of the corresponding key mount.

5. A keypad according to claim 4 wherein the associated key part is a recess and the key mount part is a projection.

6. A keypad according to claim 5 wherein the recess and the projection are of circular cross-section.

7. A keypad according to claim 6 wherein the recess and the projection include co-pending formations to prevent rotation of the associated key relative to the corresponding key mount.

8. A keypad according to claim 7 wherein the formations comprise a projection in the recess and a depression in the projection.

9. A keypad according to claim 8 wherein the projection and the depression are cruciform in shape with a limb of each shape leading from an edge of the associated part.

10. A keypad according to claim 1 wherein each associated key and the respective key hole are rectangular in cross-section.

11. A keypad according to claim 1 wherein each associated key is provided with means which, on depression of the associated key, create a flow of air tending to expel liquid held between the associated key mount and the housing.

12. A keypad according to claim 1 wherein said at least two key mounts are each formed from an elastomeric material with each said peripheral rib being connected to a central core by a flexible web, the flexible web holding the central core normally in an inoperative position, the central core being movable to an operative position against the force applied by the flexible web to operate the first contact.

13. A keypad according to claim 12, further comprising:

a circuit board having a second contact, the first and second contacts coming in contact when the central core moves to the operative position.

14. A keypad according to claim 13 wherein the first contact is operated for contact with the second contact when the associated key is below the level of an adjacent surface of the housing.

15. A keypad according to claim 1 wherein each key mount is formed separately.

16. A keypad according to claim 1 wherein each key mount is formed as a single member.

* * * * *

UNITED STATES PATENT AND TRADEMARK OFFICE

CERTIFICATE OF CORRECTION

PATENT NO. : 5,704,467

DATED : January 6, 1998

INVENTOR(S) : Peter W. Jarvis

It is certified that error appears in the above-identified patent and that said Letters Patent is hereby corrected as shown below:

Column 3, line 52, delete "32" and insert --33--;
Column 4, line 21, delete "49" and insert --47--;

line 60, delete ",";
line 62, after "each" delete "key-mount" and insert --key mount--; and
Column 5, line 1, after "wherein" delete "a" and insert --said--.

Signed and Sealed this

Sixteenth Day of June, 1998

*Attest:*

*Attesting Officer*

BRUCE LEHMAN

*Commissioner of Patents and Trademarks*